US009696044B2

(12) United States Patent
Shaffer et al.

(10) Patent No.: US 9,696,044 B2
(45) Date of Patent: Jul. 4, 2017

(54) AIR CONDITIONER UNITS AND METHODS FOR PROVIDING MAKE-UP AIR

(71) Applicant: General Electric Company, Schenectady, NY (US)

(72) Inventors: Timothy Scott Shaffer, La Grange, KY (US); Shaun Michael Ward, Louisville, KY (US)

(73) Assignee: Haier US Applicance Solutions, Inc., Wilmington, DE (US)

( * ) Notice: Subject to any disclaimer, the term of this patent is extended or adjusted under 35 U.S.C. 154(b) by 98 days.

(21) Appl. No.: 14/799,970

(22) Filed: Jul. 15, 2015

(65) Prior Publication Data

US 2017/0016635 A1 Jan. 19, 2017

(51) Int. Cl.

| | |
|---|---|
| ***F24F 7/007*** | (2006.01) |
| ***F24F 11/00*** | (2006.01) |
| ***F24F 1/02*** | (2011.01) |
| ***F24F 13/10*** | (2006.01) |
| ***F24F 13/28*** | (2006.01) |

(52) U.S. Cl.

CPC ..... *F24F 1/027* (2013.01); *F24F 11/0012* (2013.01); *F24F 11/0015* (2013.01); *F24F 2011/0013* (2013.01); *F24F 2011/0016* (2013.01)

(58) Field of Classification Search

CPC .... F24F 1/027; F24F 11/0015; F24F 11/0076; F24F 1/02; F24F 2011/0012; F24F 2011/0013; F24F 2011/0016; F24F 2221/32; F24F 13/28; Y02B 30/743; Y02B 30/741; Y02B 30/767; Y02B 30/78; Y02B 30/746

USPC ..... 62/79, 99, 427, 96

See application file for complete search history.

(56) References Cited

U.S. PATENT DOCUMENTS

| | | | | | |
|---|---|---|---|---|---|
| 4,885,916 | A * | 12/1989 | Arndt | B60H 1/00371 | 62/244 |
| 4,938,032 | A * | 7/1990 | Mudford | F24F 1/027 | 62/160 |
| 5,112,024 | A * | 5/1992 | Stanko | F16F 15/046 | 248/603 |
| 5,329,784 | A * | 7/1994 | Kennedy | F24F 1/027 | 248/188.2 |
| 5,738,492 | A * | 4/1998 | Stanko | F04D 29/422 | 415/211.1 |

(Continued)

*Primary Examiner* — Mohammad M Ali

(74) *Attorney, Agent, or Firm* — Dority & Manning, P.A.

(57) ABSTRACT

Air conditioner units and methods for providing make-up air are provided. An air conditioner unit includes an outdoor heat exchanger, an indoor heat exchanger and a bulkhead. The air conditioner unit further includes a vent aperture defined in a rear wall of the bulkhead. The air conditioner unit further includes a dehumidification system, the dehumidification system including an evaporator assembly and a condenser assembly. The evaporator assembly is configured for removing heat from outdoor air flowing therethrough. The evaporator assembly is in fluid communication with the vent aperture for flowing outdoor air from the evaporator assembly through the vent aperture. The condenser assembly is configured for adding heat to outdoor air flowing therethrough. The condenser assembly is spaced from the vent aperture for flowing outdoor air from the condenser assembly into the outdoor portion.

20 Claims, 8 Drawing Sheets

(56) References Cited

U.S. PATENT DOCUMENTS

| | | | | |
|---|---|---|---|---|
| 5,992,160 | A | 11/1999 | Bussjager et al. | |
| 6,009,716 | A * | 1/2000 | Aoto | F24F 1/027 62/262 |
| 7,628,026 | B1 | 12/2009 | Kritsky et al. | |
| 2011/0226443 | A1* | 9/2011 | Siegel | F24F 7/013 165/59 |
| 2014/0170958 | A1* | 6/2014 | Cursetjee | F24F 3/1603 454/292 |
| 2014/0196385 | A1* | 7/2014 | Demster | F24F 1/022 52/173.1 |

* cited by examiner

AIR CONDITIONER UNITS AND METHODS FOR PROVIDING MAKE-UP AIR

FIELD OF THE INVENTION

The present disclosure relates generally to air conditioner units, and more particularly to air conditioner units which utilize dehumidification systems and which provide make-up air therethrough.

BACKGROUND OF THE INVENTION

Air conditioner units are conventionally utilized to adjust the temperature within structures such as dwellings and office buildings. In particular, one-unit type room air conditioner units may be utilized to adjust the temperature in, for example, a single room or group of rooms of a structure. A typical such air conditioner unit includes an indoor portion and an outdoor portion. The indoor portion is generally located indoors, and the outdoor portion is generally located outdoors. Accordingly, the air conditioner unit generally extends through a wall, window, etc. of the structure.

In the outdoor portion of a conventional air conditioner unit, a compressor that operates a refrigerating cycle is provided. At the back of the outdoor portion, an outdoor heat exchanger connected to the compressor is disposed, and facing the outdoor heat exchanger, an outdoor fan for cooling the outdoor heat exchanger is provided. At the front of the indoor portion of a conventional air conditioner unit, an air inlet is provided, and above the air inlet, an air outlet is provided. A blower fan and a heating unit are additionally provided in the indoor portion. Between the blower fan and heating unit and the air inlet, an indoor heat exchanger connected to the compressor is provided.

When cooling operation starts, the compressor is driven to operate the refrigerating cycle, with the indoor heat exchanger serving as a cold-side evaporator of the refrigerating cycle, and the outdoor heat exchanger as a hot-side condenser. The outdoor heat exchanger is cooled by the outdoor fan to dissipate heat. As the blower fan is driven, the air inside the room flows through the air inlet into the air passage, and the air has its temperature lowered by heat exchange with the indoor heat exchanger, and is then blown into the room through the air outlet. In this way, the room is cooled.

When heating operation starts, the heating unit is operated to raise the temperature of air in the air passage. The air, having had its temperature raised, is blown out through the air outlet into the room to heat the room.

Further, conventional air conditioner units include a bulkhead which is positioned between the indoor portion and outdoor portion, and thus generally separates the components within the indoor portion from the components in the outdoor portion. Various components may additionally be connected to the bulkhead, such as the blower fan and heating unit.

In some cases, it may be desirable to allow outdoor air through the bulkhead into a room into which the air conditioner unit extends. Accordingly, many bulkheads include vent apertures for allowing such airflow. However, issues may occur when the outdoor air being flowed through the vent aperture is, for example, at a relatively high humidity level and/or relatively high temperature level. Such air may, for example, cause discomfort to a user of the air conditioner appliance.

Some air conditioner units include apparatus for dehumidifying air that is flowed through such vent apertures.

However, these apparatus typically raise the temperature of the air from which the humidity is removed, resulting in hot air being flowed through the vent apertures. These air conditioner units accordingly do not solve the comfort issues for users of the air conditioner appliances.

Accordingly, improved air conditioner units and associated methods for providing make-up air are desired. In particular, air conditioner units and associated methods which can reduce the humidity and temperature of air flowed through vent apertures of the air conditioner units would be advantageous.

BRIEF DESCRIPTION OF THE INVENTION

Aspects and advantages of the invention will be set forth in part in the following description, or may be obvious from the description, or may be learned through practice of the invention.

In accordance with one embodiment, an air conditioner unit is provided. The air conditioner unit includes an outdoor heat exchanger disposed in an outdoor portion, an indoor heat exchanger disposed in an indoor portion, and a bulkhead disposed between the outdoor heat exchanger and the indoor heat exchanger along a transverse direction. The bulkhead defines the indoor portion and the outdoor portion, and includes a first sidewall, a second sidewall spaced apart from the first sidewall along a lateral direction, and a rear wall extending laterally between the first sidewall and the second sidewall. The rear wall includes an indoor facing surface and an opposing outdoor facing surface. The air conditioner unit further includes a vent aperture defined in the rear wall. The air conditioner unit further includes a dehumidification system, the dehumidification system including an evaporator assembly and a condenser assembly. The evaporator assembly is configured for removing heat from outdoor air flowing therethrough. The evaporator assembly is in fluid communication with the vent aperture for flowing outdoor air from the evaporator assembly through the vent aperture, The condenser assembly is configured for adding heat to outdoor air flowing therethrough. The condenser assembly is spaced from the vent aperture for flowing outdoor air from the condenser assembly into the outdoor portion.

In accordance with another embodiment, a method for providing make-up air through an air conditioner unit is provided. The method includes activating a fan positioned adjacent a vent aperture defined in a bulkhead of the air conditioner unit. The bulkhead defines an indoor portion and an outdoor portion and is disposed between an outdoor heat exchanger and an indoor heat exchanger along a transverse direction. The fan is operable to flow outdoor air from the outdoor portion through the vent aperture to the indoor portion. The method further includes activating a dehumidification system when a humidity level in the outdoor portion is above a predetermined humidity threshold and a temperature level in the outdoor portion is above a predetermined temperature threshold. The dehumidification system includes an evaporator assembly in fluid communication with the vent aperture for flowing outdoor air from the evaporator assembly through the vent aperture and a condenser assembly spaced from the vent aperture for flowing outdoor air from the condenser assembly into the outdoor portion.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which.

DETAILED DESCRIPTION OF THE INVENTION

Figure 1:
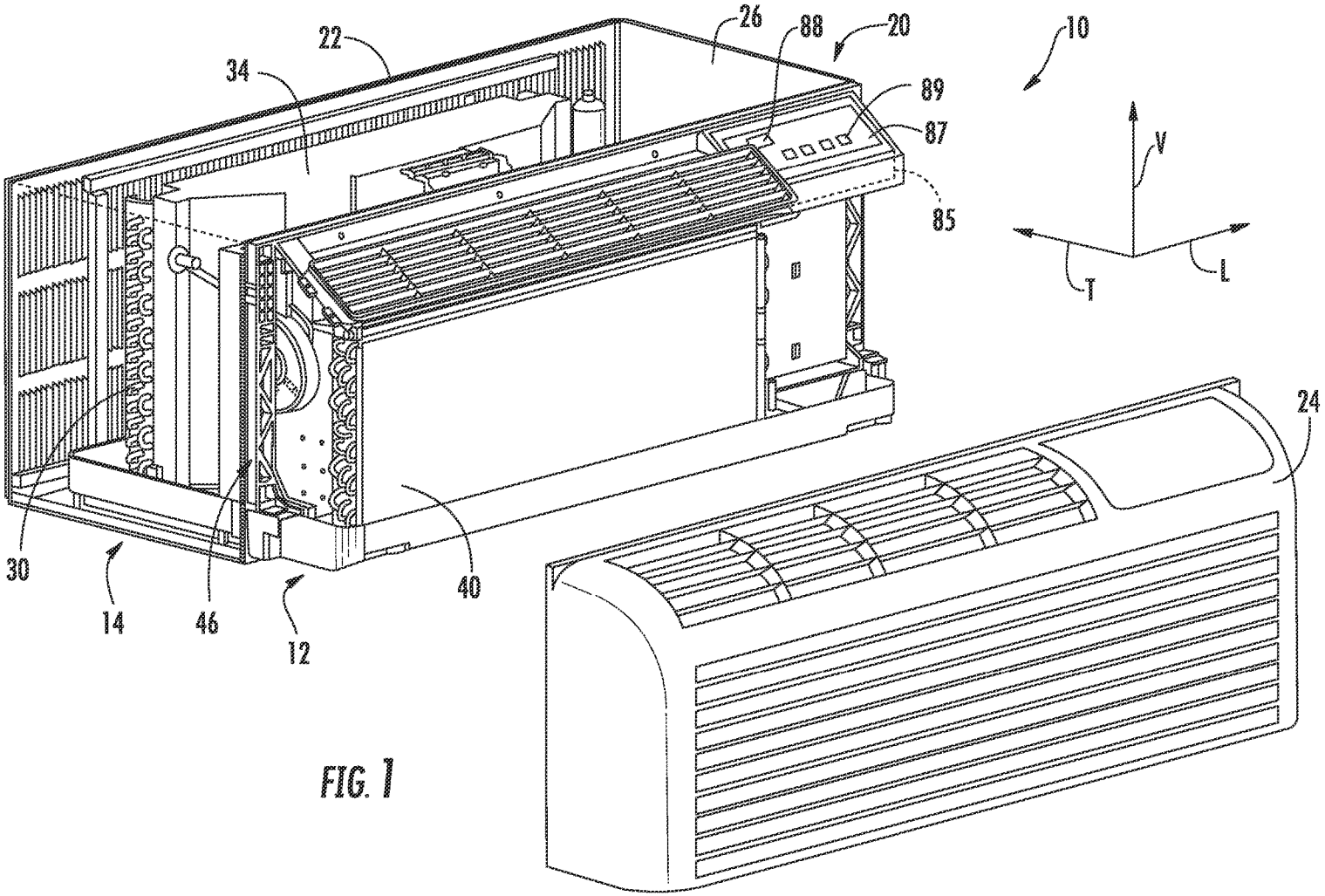
FIG. 1 provides a perspective view of an air conditioner unit, with a room front exploded from a remainder of the air conditioner unit for illustrative purposes, in accordance with one embodiment of the present disclosure.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Referring now to FIG. 1, an air conditioner unit 10 is provided. The air conditioner unit 10 is a one-unit type air conditioner, also conventionally referred to as a room air conditioner. The unit 10 includes an indoor portion 12 and an outdoor portion 14, and generally defines a vertical direction V, a lateral direction L, and a transverse direction T. Each direction V, L, T is perpendicular to each other, such that an orthogonal coordinate system is generally defined.

A housing 20 of the unit 10 may contain various other components of the unit 10. Housing 20 may include, for example, a rear grill 22 and a room front 24 which may be spaced apart along the transverse direction by a wall sleeve 26. The rear grill 22 may be part of the outdoor portion 14, which the room front 24 is part of the indoor portion 12. Components of the outdoor portion 14, such as an outdoor heat exchanger 30, outdoor fan (not shown), and compressor (not shown) may be housed within the wall sleeve 26. A casing 34 may additionally enclose the outdoor fan, as shown.

Figure 2:
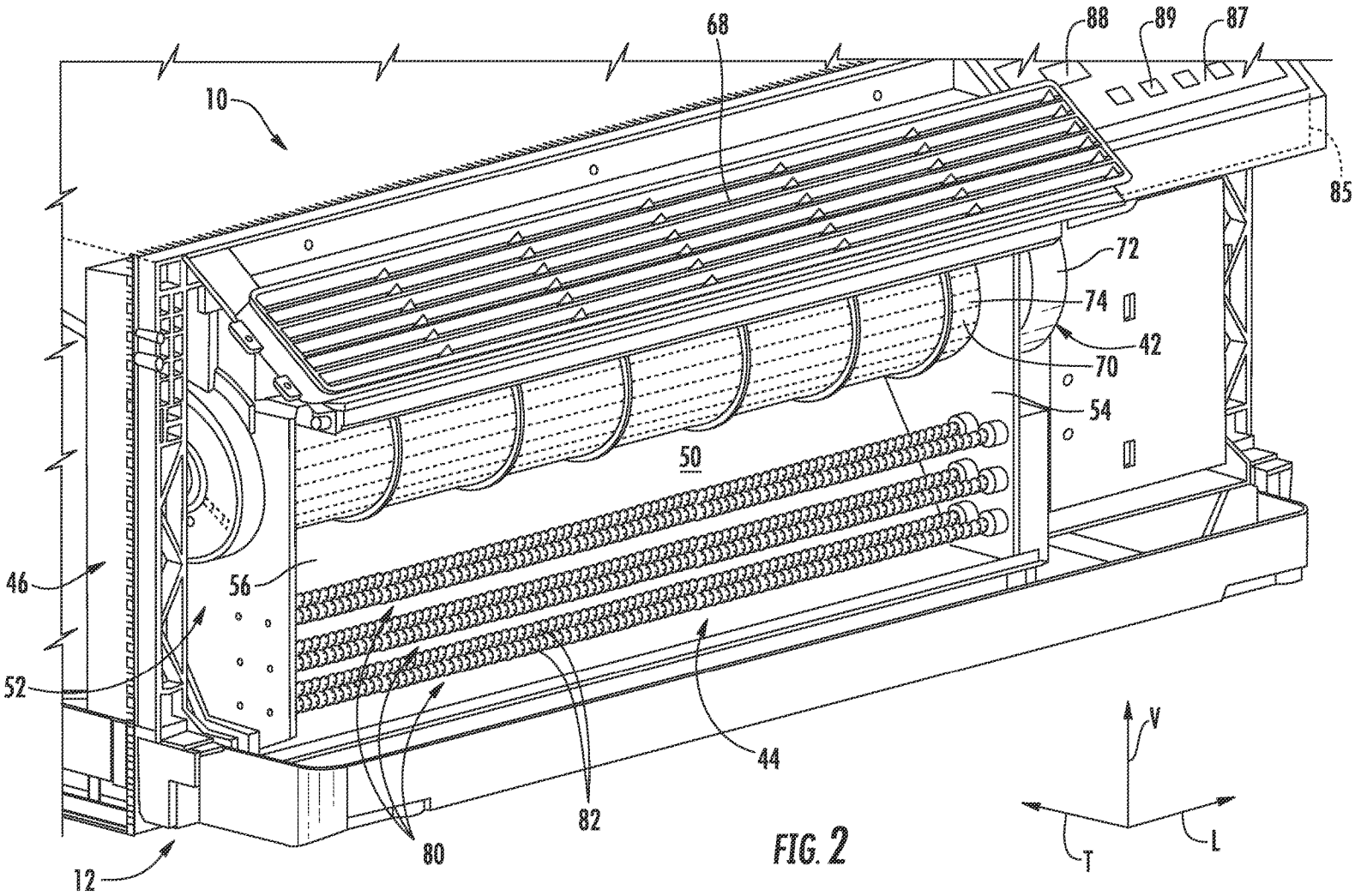
FIG. 2 is a perspective view of components of an indoor portion of an air conditioner unit in accordance with one embodiment of the present disclosure.

Referring now to FIGS. 1 and 2, indoor portion 12 may include, for example, an indoor heat exchanger 40, a blower fan 42, and a heating unit 44. These components may, for example, be housed behind the room front 24. Additionally, a bulkhead 46 may generally support and/or house various other components or portions thereof of the indoor portion 12, such as the blower fan 42 and the heating unit 44. Bulkhead 46 may generally separate and define the indoor portion 12 and outdoor portion 14.

Bulkhead 46 may include various peripheral surfaces that define an interior 50 thereof. For example, and additionally referring to FIGS. 3 and 4, bulkhead 46 may include a first sidewall 52 and a second sidewall 54 which are spaced apart from each other along the lateral direction L. A rear wall 56 may extend laterally between the first sidewall 52 and second sidewall 54. The rear wall 56 may, for example, include an upper portion 60 and a lower portion 62. Upper portion 60 may for example have a generally curvilinear cross-sectional shape, and may accommodate a portion of the blower fan 42 when blower fan 42 is housed within the interior 50. Lower portion 62 may have a generally linear cross-sectional shape, and may be positioned below upper portion 60 along the vertical direction V. Rear wall 56 may further include an indoor facing surface 64 and an opposing outdoor facing surface. The indoor facing surface 64 may face the interior 50 and indoor portion 12, and the outdoor facing surface 66 may face the outdoor portion 14.

Bulkhead 46 may additionally extend between a top end 61 and a bottom end 63 along vertical axis V. Upper portion 60 may, for example, include top end 61, while lower portion 62 may, for example, include bottom end 63.

Bulkhead 46 may additionally include, for example, an air diverter 68, which may extend between the sidewalls 52, 54 along the lateral direction L and which may flow air therethrough.

In exemplary embodiments, blower fan 42 may be a tangential fan. Alternatively, however, any suitable fan type may be utilized. Blower fan 42 may include a blade assembly 70 and a motor 72. The blade assembly 70, which may include one or more blades disposed within a fan housing 74, may be disposed at least partially within the interior 50 of the bulkhead 46, such as within the upper portion 60. As shown, blade assembly 70 may for example extend along the lateral direction L between the first sidewall 52 and the second sidewall 54. The motor 72 may be connected to the blade assembly 70, such as through the housing 74 to the blades via a shaft. Operation of the motor 72 may rotate the blades, thus generally operating the blower fan 42. Further, in exemplary embodiments, motor 72 may be disposed exterior to the bulkhead 46. Accordingly, the shaft may for example extend through one of the sidewalls 52, 54 to connect the motor 72 and blade assembly 70.

Heating unit 44 in exemplary embodiments includes one or more heater banks 80. Each heater bank 80 may be operated as desired to produce heat. In some embodiments as shown, three heater banks 80 may be utilized. Alternatively, however, any suitable number of heater banks 80 may be utilized. Each heater bank 80 may further include at least one heater coil or coil pass 82, such as in exemplary embodiments two heater coils or coil passes 82. Alternatively, other suitable heating elements may be utilized.

The operation of air conditioner unit 10 including blower fan 42, heating unit 44, and other suitable components may be controlled by a processing device such as a controller 85. Controller 85 may be in communication (via for example a suitable wired or wireless connection) to such components of the air conditioner unit 10. By way of example, the controller 85 may include a memory and one or more processing devices such as microprocessors, CPUs or the like, such as general or special purpose microprocessors operable to execute programming instructions or micro-control code associated with operation of unit 10. The memory may represent random access memory such as DRAM, or read only memory such as ROM or FLASH. In one embodiment, the processor executes programming instructions stored in memory. The memory may be a separate component from the processor or may be included onboard within the processor.

Unit 10 may additionally include a control panel 87 and one or more user inputs 89, which may be included in control panel 87. The user inputs 89 may be in communication with the controller 85. A user of the unit 10 may interact with the user inputs 89 to operate the unit 10, and user commands may be transmitted between the user inputs 89 and controller 85 to facilitate operation of the unit 10 based on such user commands. A display 88 may additionally be provided in the control panel 87, and may be in communication with the controller 85. Display 88 may, for example be a touchscreen or other text-readable display screen, or alternatively may simply be a light that can be activated and deactivated as required to provide an indication of, for example, an event or setting for the unit.

Figure 3:
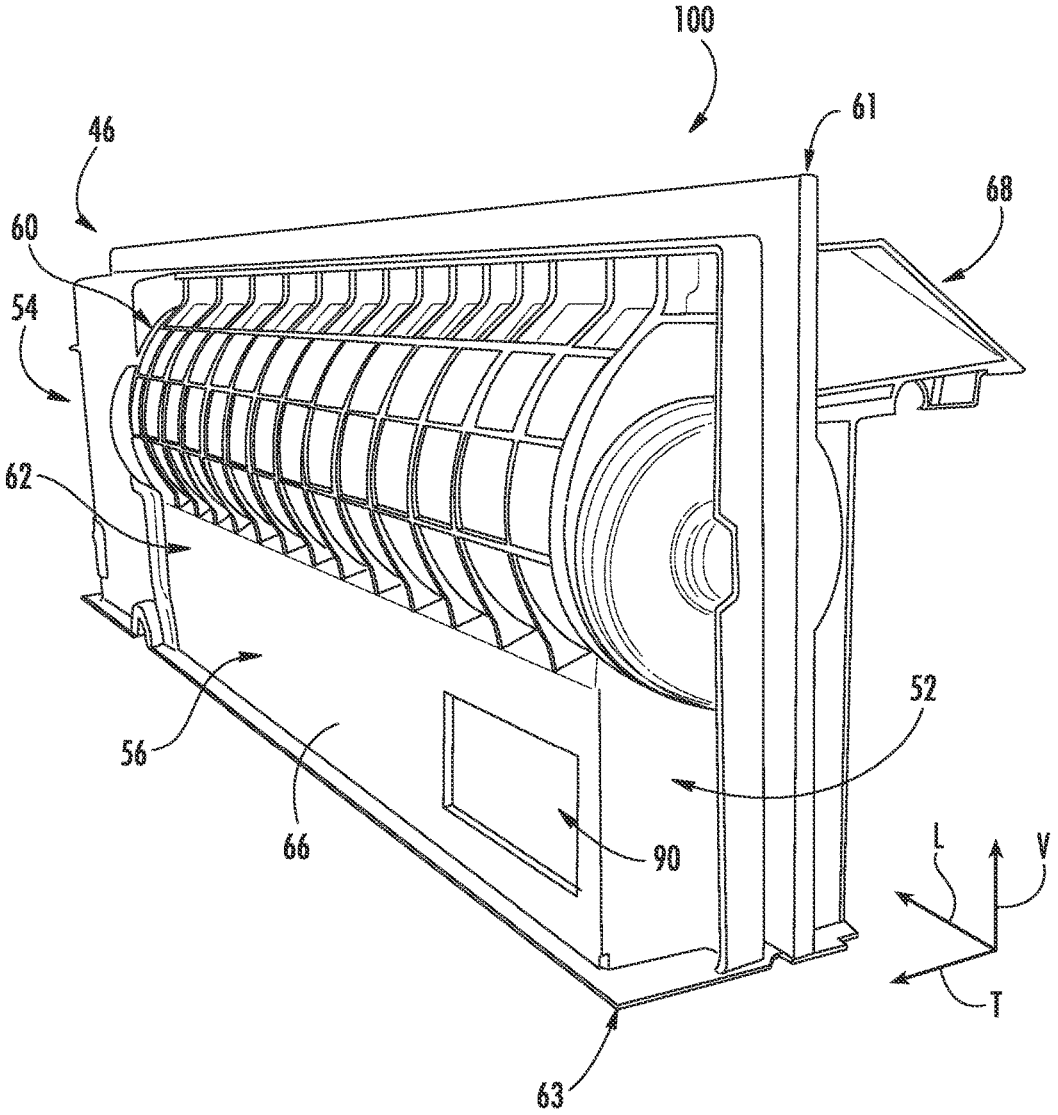
FIG. 3 is a rear perspective view of a bulkhead assembly in accordance with one embodiment of the present disclosure.
Figure 4:
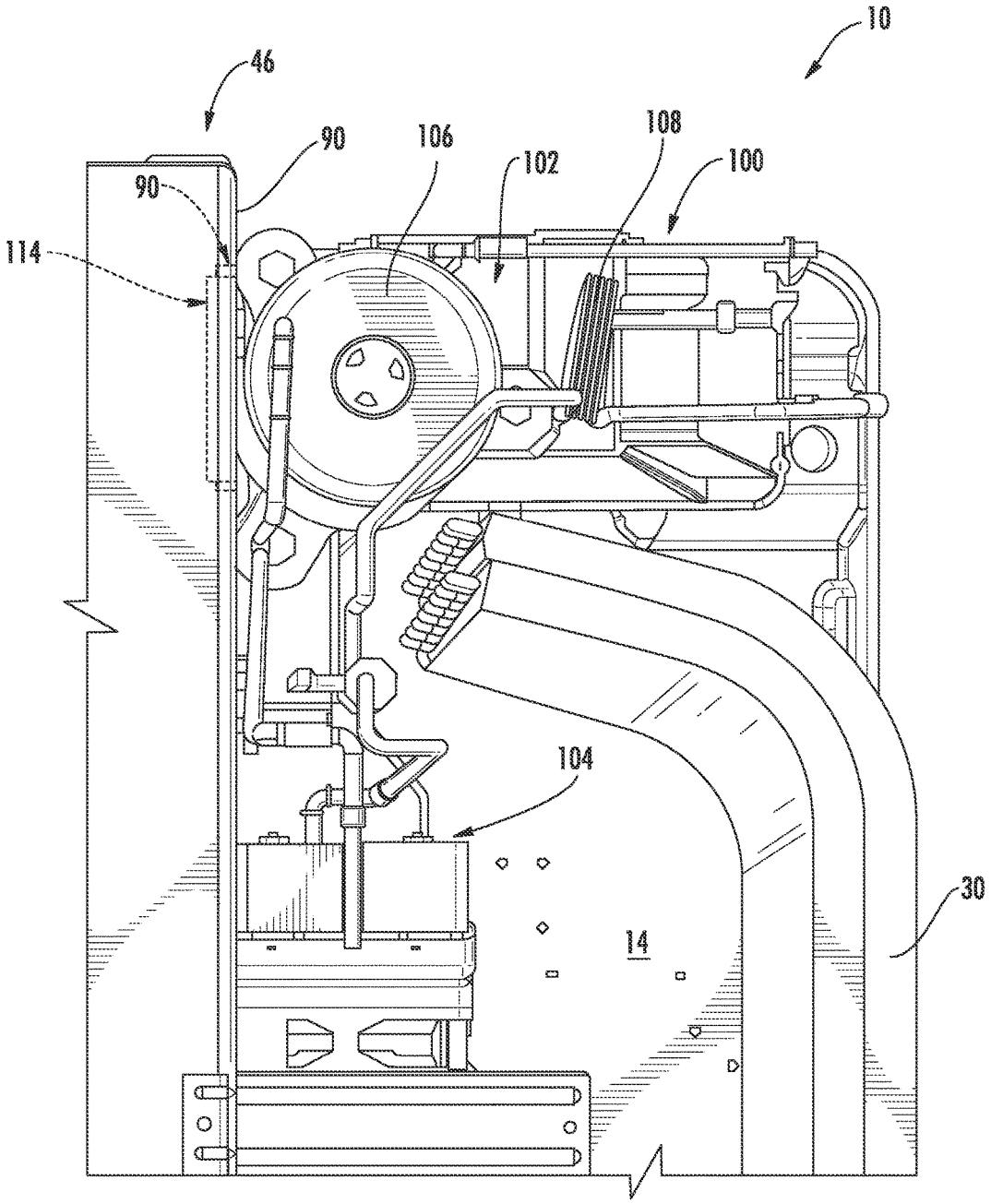
FIG. 4 is a top view of a bulkhead, outdoor portion and dehumidification system of an air conditioner unit in accordance with one embodiment of the present disclosure.
Figure 5:
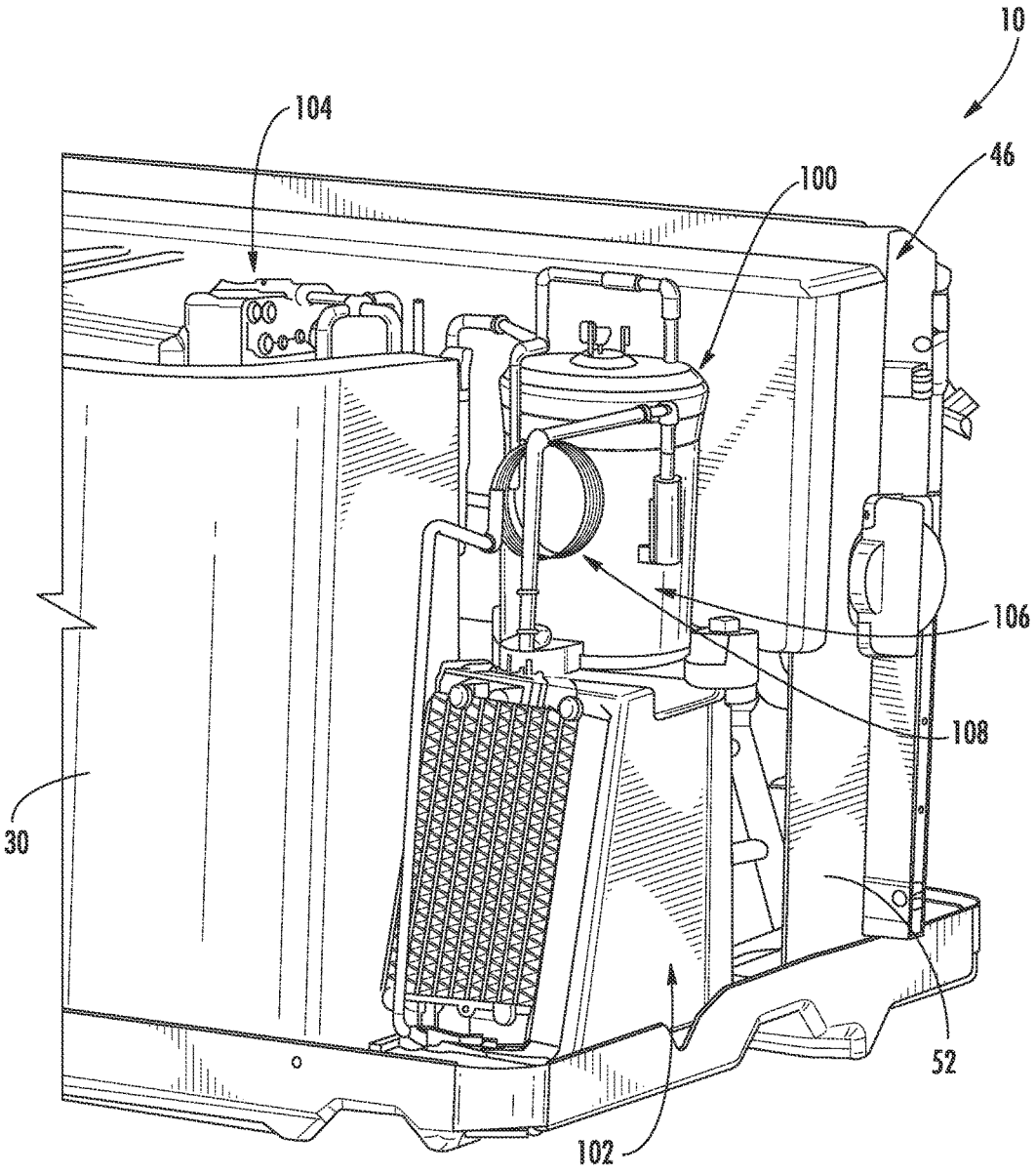
FIG. 5 is a rear perspective view of a bulkhead, outdoor portion and dehumidification system of an air conditioner unit in accordance with one embodiment of the present disclosure.
Figure 6:
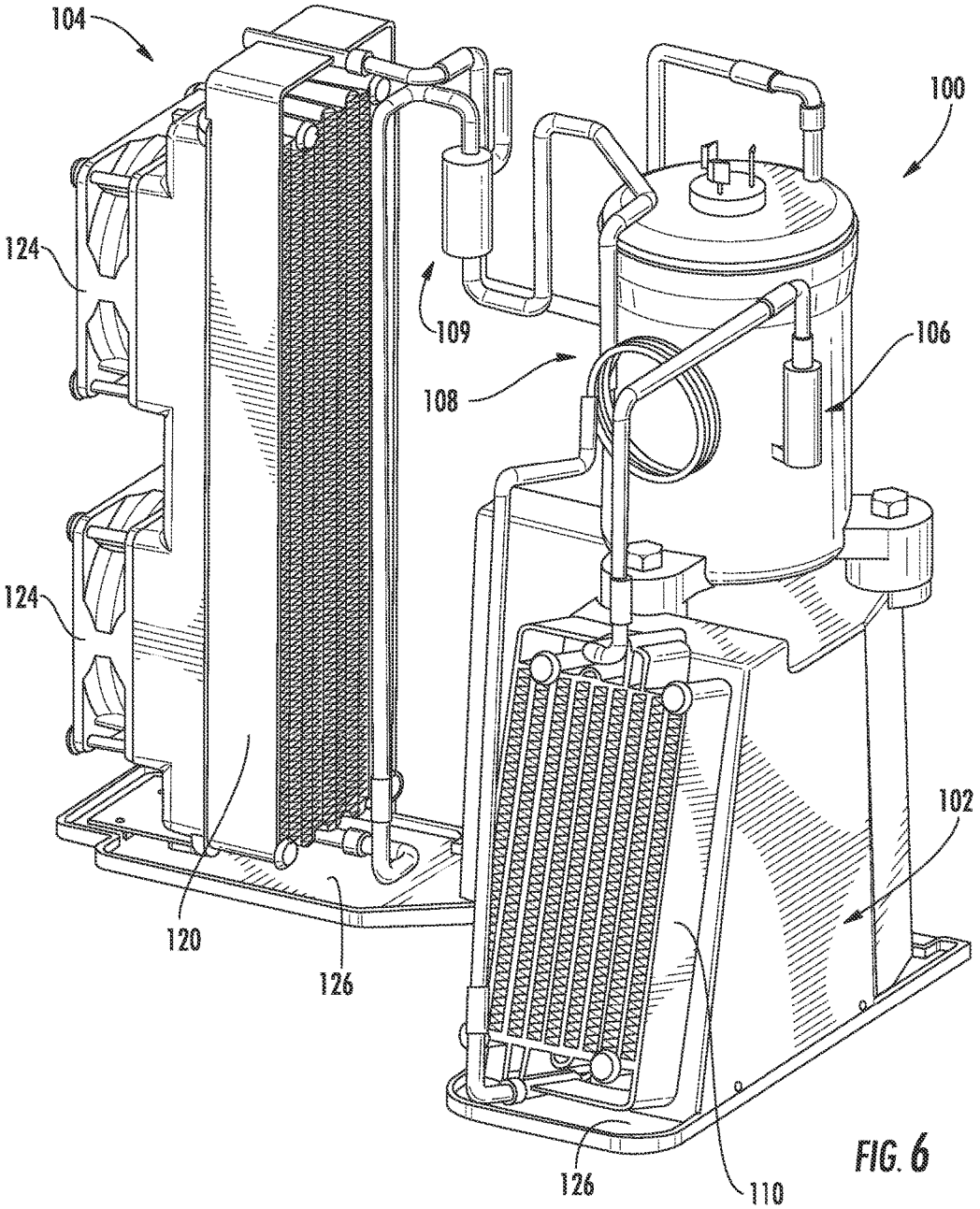
FIG. 6 is a rear perspective view of a dehumidification system in accordance with one embodiment of the present disclosure.
Figure 7:
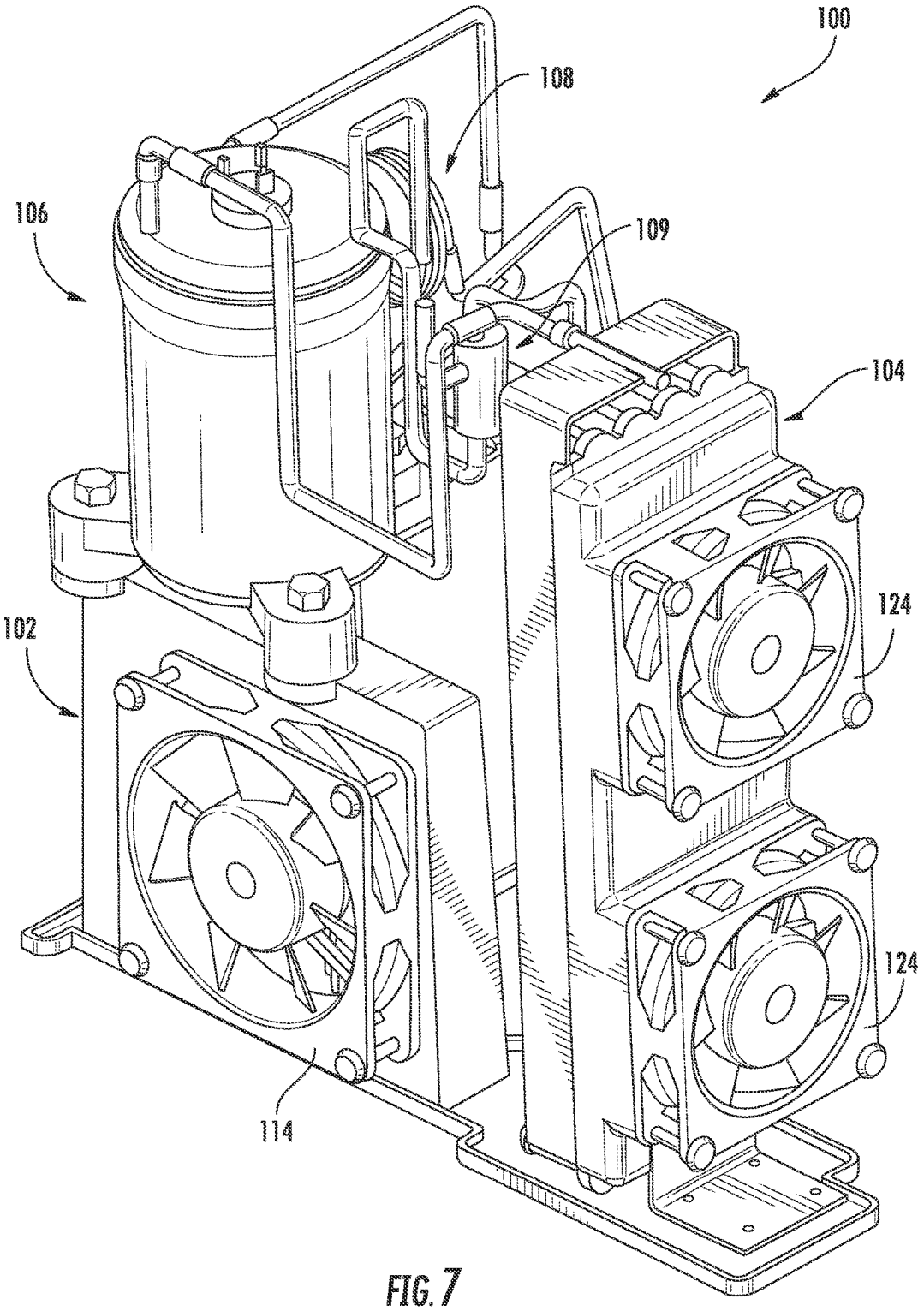
FIG. 7 is a front perspective view of a dehumidification system in accordance with one embodiment of the present disclosure.
Figure 8:
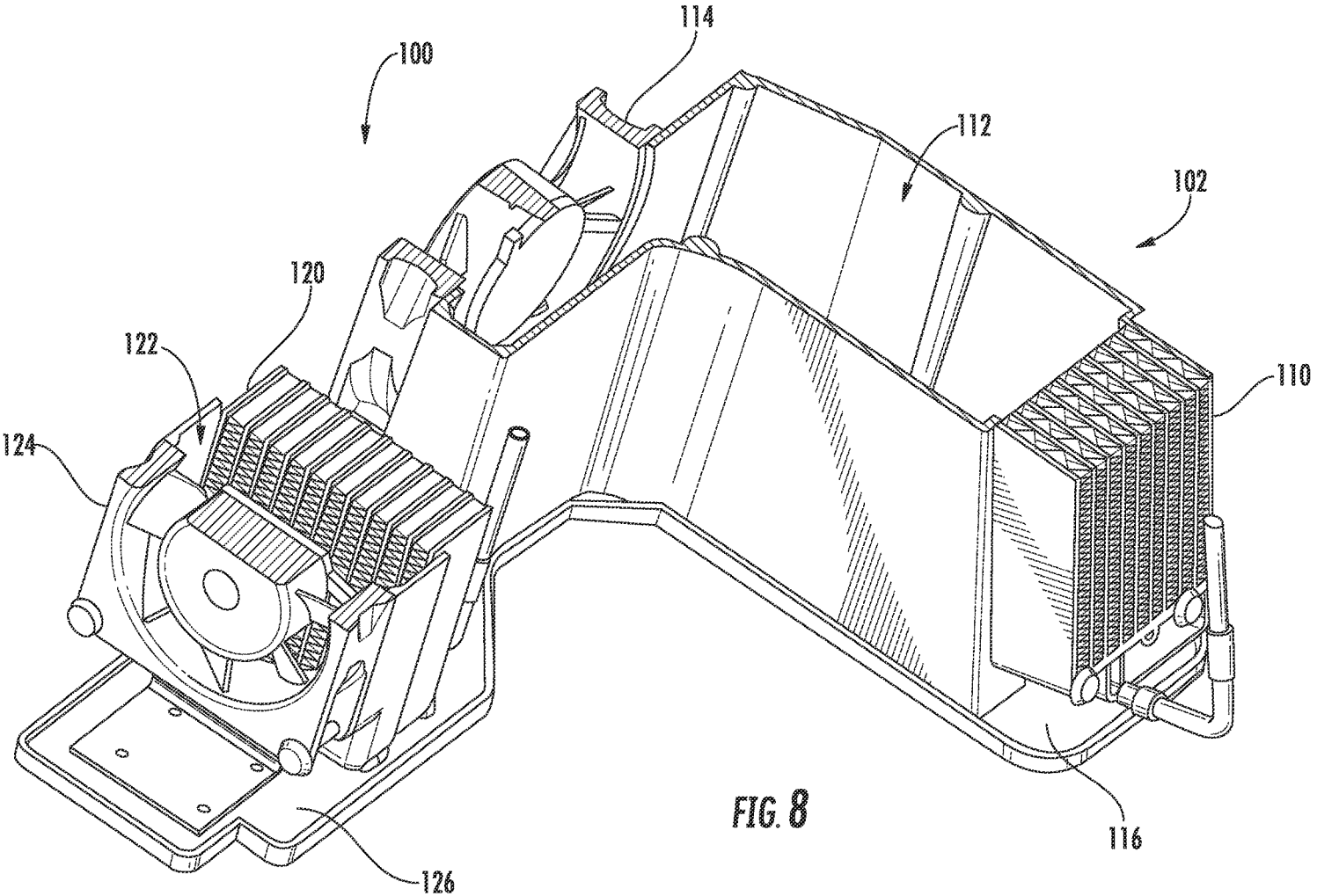
FIG. 8 is a top perspective cut-away view of a portion of a dehumidification system in accordance with one embodiment of the present disclosure.

Referring briefly to FIG. 3, a vent aperture 90 may be defined in the rear wall 56 of bulkhead 46. Vent aperture 90 may allow air flow therethrough between the indoor portion 12 and outdoor portion 14, and may be utilized in an installed air conditioner unit 10 to allow outdoor air to flow therethrough into the indoor portion 12.

As discussed, in some cases it may be desirable to treat air being flowed through the vent aperture 90. For example, outdoor air which has a relatively high humidity level and/or temperature level may require treating before being flowed through vent aperture 90 from outdoor portion 14 to indoor portion 12. Accordingly, and referring now to FIGS. 4 through 8, air conditioner unit 10 may further include a dehumidification system 100. Dehumidification system 100 may be utilized to treat outdoor air, also known as make-up air, flowing therethrough and through vent aperture 90. Advantageously, dehumidification system 100 facilitates the flow of relatively cool, dehumidified air through the vent aperture 90, and operates to flow hot air away from the vent aperture 90, thus improving operation of the air conditioner unit 10 and the comfort of users utilizing the air conditioner unit 10.

Dehumidification system 100 generally includes the components required for operation of a refrigeration cycle. For example, as illustrated, dehumidification system 100 may include an evaporator assembly 102 and a condenser assembly 104. Evaporator assembly 102 is generally configured for removing heat from outdoor air flowing therethrough, while condenser assembly 104 is generally configured for adding heat to outdoor air flowing therethrough. Advantageously, the evaporator assembly 102 and condenser assembly 104 may be positioned to interact with different flows of outdoor air that are generally independent of each other. Outdoor air flowed through evaporator assembly 102 may further be flowed through vent aperture 90, such that relatively cool, dry air is received in indoor portion 12 through vent aperture 90. Evaporator assembly 102 may thus be in fluid communication with vent aperture 90 for flowing this outdoor air from the evaporator assembly 102 through the vent aperture 90. Outdoor air flowed through condenser assembly 104 may advantageously be flowed back into the outdoor portion 14 and away from the vent aperture 90. This outdoor air may further be discharged from the outdoor portion 14 into the outdoor environment. Condenser assembly 104 may thus be spaced from vent aperture 90 for flowing this outdoor air from the condenser assembly 104 into the outdoor portion 14.

Evaporator assembly 102 may, for example, include an evaporator 110, an evaporator duct 112, and an evaporator fan 114. Additionally, a drip pan 116 may be provided below the evaporator duct 112 as well as the evaporator 110 and fan 114. Evaporator 110 may be any suitable heat exchanger configured to operate as an evaporator, and in particular may be a suitable indirect heat exchanger such as a microchannel evaporator. Outdoor air may generally be flowed through the evaporator 110. During such flow through the evaporator 110 the outdoor air may transmit heat to a suitable refrigerant being flowed through the evaporator 110, thus cooling the outdoor air. Additionally, such heat dump may cause moisture condensation from the outdoor air. This condensation may collect on the evaporator 110 and/or in the duct 112. Condensation on the evaporator 110 may flow into the duct 112 and/or into the drip pan 116, and condensation in the duct 112 may flow into the drip pan 116. Such condensation removes moisture from the outdoor air, such that the outdoor air exiting the evaporator 110 may be relatively cooler and dryer than the outdoor air entering the evaporator 110.

Evaporator duct 112 may generally be provided for outdoor air to flow through, such as after being flowed through evaporator 110. Evaporator fan 114 may operate to encourage the flow of outdoor air through the evaporator 110 and therethrough to the vent aperture 90. In exemplary embodiments, evaporator duct 112 may be positioned downstream of the evaporator 110 and evaporator fan 114 may be positioned downstream of the evaporator duct 112 along the flow direction of outdoor air through the evaporator assembly 102. Accordingly, fan 114 may operate to pull air through the evaporator 110 and duct 112. A flow path for outdoor air may thus be defined through and by the evaporator assembly 102. This flow path of outdoor air may be directed towards and into the vent aperture 90.

As illustrated, evaporator 110 and evaporator duct 112 may be disposed in the outdoor portion 14. Fan 114 may, in some embodiments as illustrated, be disposed at least partially within vent aperture 90. Additionally or alternatively, fan 114 may be partially or wholly disposed in outdoor portion 14 or partially or wholly disposed in indoor portion 12. Accordingly, outdoor air flow through evaporator assembly 102 may be flowed past fan 114 into and through vent aperture 90.

Condenser assembly 104 may, for example, include a condenser 120, a condenser duct 122, and one or more condenser fans 124. Additionally, a drip pan 126 may be provided below the condenser duct 122 as well as the condenser 120 and fans 124. Drip pan 126 may be separate from or integral with drip pan 116. Condenser 120 may be any suitable heat exchanger configured to operate as a condenser, and in particular may be a suitable indirect heat exchanger such as a microchannel condenser. Outdoor air (independent from the outdoor air flowed through condenser assembly 102) may generally be flowed through the condenser 120. During such flow through the condenser 120 the refrigerant may transmit heat to the outdoor air being flowed through the condenser 120, thus heating the outdoor air. Accordingly, the outdoor air exiting the condenser 120 may be relatively hotter than the outdoor air entering the condenser 120.

Condenser duct 122 may generally be provided for outdoor air to flow through, such as after being flowed through condenser 120. Condenser fan 124 may operate to encourage the flow of outdoor air through the condenser 120 and condenser duct 122. In exemplary embodiments, condenser duct 122 may be positioned downstream of the condenser 120 and condenser fan 124 may be positioned downstream of the condenser duct 122 along the flow direction of outdoor air through the condenser assembly 104. Accordingly, fan 124 may operate to pull air through the condenser 120 and duct 122. A flow path for outdoor air may thus be defined through and by the condenser assembly 104. This flow path of outdoor air may be directed away from the vent aperture 90.

As illustrated, condenser assembly 104, including condenser 120, condenser duct 122, and fans 124, may be disposed in the outdoor portion 14. Outdoor air flowed through the condenser assembly 104 is thus exhausted therefrom into the outdoor portion 14, and may further be exhausted from the outdoor portion 14 into the outdoor environment.

As illustrated, dehumidification system 100 may further include a compressor 106 and an expansion device 108. In exemplary embodiments as illustrate, compressor 106 and expansion device 108 may be disposed in the outdoor portion 14. Expansion device 108 may, for example, be a capillary tube as illustrated or another suitable expansion device configured for use in a refrigeration cycle. Various lines may additionally be provided for flowing refrigerant between the various components of the dehumidification device 100, such as the evaporator 110, condenser 120, compressor 106 and expansion device 108. Refrigerant may thus flow through such lines from evaporator 110 to compressor 106, from compressor 106 to condenser 120, from condenser 120 to expansion device 108, and from expansion device 108 to evaporator 110. The refrigerant may generally undergo phase changes associated with a refrigeration cycle as it flows to and through these various components, as is generally understood. One suitable refrigerant for use in dehumidification system 100 is 1,1,1,2-Tetrafluoroethane, also known as R-134A, although it should be understood that the present disclosure is not limited to such example and rather that any suitable refrigerant may be utilized.

Additionally, in exemplary embodiments, a dryer 109 may be included in dehumidification system 100. Dryer 109 may flow refrigerant therethrough to remove moisture from the refrigerant, and may be positioned for example between condenser 120 and expansion device 108. Any suitable drying apparatus suitable for use in a system utilizing a refrigeration cycle, such as for example including a suitable desiccant, may be utilized.

As discussed, air conditioner unit 10 may include a controller 85. Controller 85 may be in communication with dehumidification system 100, and may be configured to operate dehumidification system 100 and the various components thereof For example, in exemplary embodiments, controller 85 may be configured to activate the dehumidification system 100 (to operate in a refrigeration cycle) when a humidity level in the outdoor portion 14 is above a predetermined humidity threshold and/or a temperature threshold in the outdoor portion 14 is above a predetermined temperature threshold. Controller 85 may further be configured to deactivate the dehumidification system 100 when a humidity level in the outdoor portion 14 is below the predetermined humidity threshold and/or a temperature threshold in the outdoor portion 14 is below the predetermined temperature threshold. The predetermined humidity threshold may, for example, be between approximately 40% and approximately 70% relative humidity, such as between approximately 50% and approximately 60% relative humidity, such as approximately 55% relative humidity. The predetermined temperature threshold may, for example, be between approximately 40° F. and approximately 60° F., such as approximately 50° F.

Unit 10 may, for example, include a suitable temperature sensor 130 and suitable humidity sensor 132 for measuring temperature and humidity levels, respectively. The sensors 130, 132 may be in communication with the controller 85 such that the controller 85 receives the temperature and humidity levels from the sensor 130, 132 and can activate and deactivate the dehumidification system 100 as required. In exemplary embodiments as illustrated, temperature sensor 130 and humidity sensor 132 may be disposed in the outdoor portion 14.

Additionally, it should be noted that evaporator fan 114 may be operable both within dehumidification system 100 and independently of dehumidification system 100. For example, controller 85 may be operable to activate and deactivate evaporator fan 114 as part of dehumidification system 100. Further, controller 85 may be operable to activate and deactivate evaporator fan 114 independently of dehumidification system 100. For example, it may be desirable to flow outdoor air through vent aperture 90 without activating dehumidification system 100 to cool and dry the outdoor air, such as when the humidity in the outdoor portion 14 is below the predetermined humidity threshold and/or the temperature in the outdoor portion 14 is below the predetermined temperature threshold. In these cases, controller 85 may activate evaporator fan 114 independently of the dehumidification system 100 to encourage the flow of outdoor air through vent aperture 90.

Further, it should be noted that condenser fans 124 may be operable both within dehumidification system 100 and independently of dehumidification system 100. For example, controller 85 may be operable to activate and deactivate condenser fans 124 as part of dehumidification system 100. Further, controller 85 may be operable to activate and deactivate condenser fans 124 independently of dehumidification system 100. For example, condenser fans 124 may be activated to supplement the outdoor fan (not shown) of the air conditioner unit 100 during normal operation of the air conditioner unit 100.

The present disclosure is further directed to methods for providing make-up air through air conditioner units 10. In exemplary embodiments, controller 85 may perform the various steps of a method as discussed herein. A method may include, for example, the step of activating a fan 114 positioned adjacent a vent aperture 90, as discussed herein. Such activation may, for example, be independent of a dehumidification system 100, as discussed herein. Such activation may, for example, occur when a humidity level in an outdoor portion 14 is below a predetermined humidity threshold and/or a temperature threshold in the outdoor portion 14 is below a predetermined temperature threshold, as discussed herein.

The method may further include, for example, the step of activating a dehumidification system 100 (which may include the fan 114), as discussed herein. Such activation may, for example, occur when a humidity level in an outdoor portion 14 is above a predetermined humidity threshold and/or a temperature threshold in the outdoor portion 14 is above a predetermined temperature threshold, as discussed herein.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. An air conditioner unit, comprising:

an outdoor heat exchanger disposed in an outdoor portion;

an indoor heat exchanger disposed in an indoor portion;

a bulkhead disposed between the outdoor heat exchanger and the indoor heat exchanger along a transverse direction, the bulkhead defining the indoor portion and the outdoor portion, the bulkhead comprising a first sidewall, a second sidewall spaced apart from the first sidewall along a lateral direction, and a rear wall extending laterally between the first sidewall and the second sidewall between the outdoor heat exchanger and the indoor heat exchanger along the transverse direction, the rear wall comprising an indoor facing surface and an opposing outdoor facing surface;

a vent aperture defined in the rear wall; and a dehumidification system, the dehumidification system comprising:

an evaporator assembly configured for removing heat from outdoor air flowing therethrough, the evaporator assembly in fluid communication with the vent aperture for flowing outdoor air from the evaporator assembly through the vent aperture; and a condenser assembly configured for adding heat to outdoor air flowing therethrough, the condenser assembly spaced from the vent aperture for flowing outdoor air from the condenser assembly into the outdoor portion, wherein the evaporator assembly comprises an evaporator, an evaporator fan, and an evaporator duct defining a flow path for outdoor air bypassing the condenser assembly.

2. The air conditioner unit of claim 1, wherein the evaporator fan is operable within and independently of the dehumidification system.

3. The air conditioner unit of claim 1, wherein the evaporator duct is positioned downstream of the evaporator and the evaporator fan is positioned downstream of the evaporator duct along a flow direction of outdoor air through the evaporator assembly.

4. The air conditioner unit of claim 1, wherein the evaporator and evaporator duct are disposed in the outdoor portion.

5. The air conditioner unit of claim 1, wherein the evaporator fan is disposed at least partially within the vent aperture.

6. The air conditioner unit of claim 1, wherein a flow path for outdoor air through the evaporator assembly is directed towards the vent aperture.

7. The air conditioner unit of claim 1, wherein the condenser assembly comprises a condenser, a condenser duct, and a condenser fan.

8. The air conditioner unit of claim 7, wherein the condenser duct is positioned downstream of the condenser and the condenser fan is positioned downstream of the condenser duct along a flow direction of outdoor air through the condenser assembly.

9. The air conditioner unit of claim 7, wherein the condenser assembly is disposed in the outdoor portion.

10. The air conditioner unit of claim 1, wherein a flow path for outdoor air through the condenser assembly is directed away from the vent aperture.

11. The air conditioner unit of claim 1, wherein the dehumidification system further comprises a compressor and an expansion device, the compressor and expansion device disposed in the outdoor portion.

12. The air conditioner unit of claim 1, further comprising a controller in communication with the dehumidification system, the controller configured to activate the dehumidification system when a humidity level in the outdoor portion is above a predetermined humidity threshold and a temperature level in the outdoor portion is above a predetermined temperature threshold.

13. The air conditioner unit of claim 1, further comprising a temperature sensor and a humidity sensor disposed in the outdoor portion.

14. A method for providing make-up air through an air conditioner unit, the method comprising:

activating a fan positioned adjacent a vent aperture defined in a bulkhead of the air conditioner unit, the bulkhead defining an indoor portion and an outdoor portion and disposed between an outdoor heat exchanger and an indoor heat exchanger along a transverse direction, the fan operable to flow outdoor air from the outdoor portion through the vent aperture to the indoor portion; and activating a dehumidification system when a humidity level in the outdoor portion is above a predetermined humidity threshold and a temperature level in the outdoor portion is above a predetermined temperature threshold, the dehumidification system comprising an evaporator assembly in fluid communication with the vent aperture for flowing outdoor air from the evaporator assembly through the vent aperture and a condenser assembly spaced from the vent aperture for flowing outdoor air from the condenser assembly into the outdoor portion, wherein activating the dehumidification system comprises flowing a portion of outdoor air along a flow path directed through the evaporator assembly towards the vent aperture in fluid isolation away from the condenser assembly, and wherein activating a dehumidification system further comprises flowing another portion of outdoor air along a flow path directed through the condenser assembly away from the vent aperture in fluid isolation away from the evaporator assembly.

15. The method of claim 14, wherein the fan is disposed at least partially within the vent aperture.

16. The method of claim 14, wherein the evaporator assembly comprises the fan, and wherein the fan is operable within and independently of the dehumidification system.

17. The method of claim 14, wherein the evaporator assembly comprises an evaporator, an evaporator duct, and the fan.

18. An air conditioner unit, comprising:

an outdoor heat exchanger disposed in an outdoor portion;

an indoor heat exchanger disposed in an indoor portion;

a bulkhead disposed between the outdoor heat exchanger and the indoor heat exchanger along a transverse direction, the bulkhead defining the indoor portion and the outdoor portion, the bulkhead comprising a first sidewall, a second sidewall spaced apart from the first sidewall along a lateral direction, and a rear wall extending laterally between the first sidewall and the second sidewall between the outdoor heat exchanger and the indoor heat exchanger along the transverse direction, the rear wall comprising an indoor facing surface and an opposing outdoor facing surface;

a vent aperture defined in the rear wall; and a dehumidification system, the dehumidification system comprising:

an evaporator assembly configured for removing heat from outdoor air flowing therethrough, the evaporator assembly in fluid communication with the vent aperture for flowing outdoor air from the evaporator assembly through the vent aperture; and a condenser assembly configured for adding heat to outdoor air flowing therethrough, the condenser assembly spaced from the vent aperture for flowing outdoor air from the condenser assembly into the outdoor portion, wherein the evaporator assembly comprises an evaporator, an evaporator fan, and an evaporator duct defining a flow path for outdoor air bypassing the condenser assembly and directed towards the vent aperture, the evaporator and evaporator duct being disposed in the outdoor portion, wherein the condenser assembly comprises a condenser, a condenser fan, and a condenser duct directed away from the vent aperture disposed in the outdoor portion, the condenser duct being positioned downstream of the condenser and disposed in the outdoor portion.

19. The air conditioner unit of claim 18, wherein the dehumidification system further comprises a compressor and an expansion device, the compressor and expansion device disposed in the outdoor portion.

20. The air conditioner unit of claim 18, further comprising a controller in communication with the dehumidification system, the controller configured to activate the dehumidification system when a humidity level in the outdoor portion is above a predetermined humidity threshold and a temperature level in the outdoor portion is above a predetermined temperature threshold.

* * * * *